US006393960B1

(12) United States Patent
Bilger

(10) Patent No.: US 6,393,960 B1
(45) Date of Patent: May 28, 2002

(54) DEVICE FOR ATTACHING AMMUNITION BOXES TO A BOX SUPPORT FOR AN AUTOMATIC WEAPON

(75) Inventor: Gerhard Bilger, Lauterbach (DE)

(73) Assignee: Mauser-Werke Oberndorf Waffensysteme GmbH, Oberndorf (DE)

( * ) Notice: Subject to any disclaimer, the term of this patent is extended or adjusted under 35 U.S.C. 154(b) by 19 days.

(21) Appl. No.: 09/697,045

(22) Filed: Oct. 27, 2000

(30) Foreign Application Priority Data

Nov. 5, 1999 (DE) ..... 199 53 293

(51) Int. Cl.[7] ..... F41A 23/00

(52) U.S. Cl. ..... 89/37.03; 89/34; 89/33.1

(58) Field of Search ..... 89/33.01, 33.2, 89/34, 33.1, 33.14, 37.02, 37.03, 37.07, 40.08

(56) References Cited

U.S. PATENT DOCUMENTS

| | | | | |
|---|---|---|---|---|
| 1,611,289 A | * | 12/1926 | Soncini et al. | 89/33.1 |
| 1,719,127 A | * | 7/1929 | Pfeiffer et al. | 89/33.17 |
| 2,705,575 A | * | 4/1955 | Hammer | 220/32 |
| 3,246,565 A | * | 4/1966 | Ramseyer | 89/33 |
| 4,096,783 A | * | 6/1978 | Wallwey et al. | 89/34 |
| 4,297,939 A | * | 11/1981 | Castillo et al. | 89/33 L |
| 4,951,548 A | * | 8/1990 | Wixon et al. | 89/33.14 |

FOREIGN PATENT DOCUMENTS

| | | | |
|---|---|---|---|
| CH | 302187 | * 10/1954 | 89/34 |

* cited by examiner

*Primary Examiner*—Michael J. Carone
*Assistant Examiner*—Gabriel Sukman
(74) *Attorney, Agent, or Firm*—Venable; Norman N. Kunitz

(57) ABSTRACT

A box support (2) is provided on both sides with shackles (4) to make it easier to attach an ammunition box (1) to the gun mount (35) for an automatic weapon and to ensure better access to the cartridge feed belt for the loading and reloading operation, as well as to reduce the ergonomic stress when attaching the ammunition box to the gun mount. These shackles (4) have respectively one holder (5) at a distance downward that is used for suspending the ammunition box (1) such that it can pivot. The ammunition box (1) is provided with bearing bolts (13) for this purpose. Two fastening locations (7, 8) for the ammunition box (1) are provided in a longitudinal axial direction of the box support (2), at non-symmetrical distances to the holders (5). If the ammunition box (1) is suspended in the holders (5), the distance a between the first fastening location (7) and the holders (5) corresponds to the distance between the holders (5) and a first locking device (16). In contrast, the second fastening location (8) is arranged on the box support (2) at a distance to the first fastening location that corresponds to the length (L) of the ammunition box (1). Thus, following the suspension of the ammunition box in the holders (5) and a pivoting movement of the box around the holders (5), the ammunition box (1) can assume a slanted loading position (9). Following a second pivoting movement around the first fastening location (7), the box (1) can assume an ammunition unloading position (12).

8 Claims, 7 Drawing Sheets

DEVICE FOR ATTACHING AMMUNITION BOXES TO A BOX SUPPORT FOR AN AUTOMATIC WEAPON

CROSS REFERENCE TO RELATED APPLICATIONS

The present application claims the right of foreign priority of German Application No. DE 199 53 293.1 filed Nov. 5, 1999, the subject matter of which is incorporated herein by reference.

BACKGROUND OF THE INVENTION

The invention relates to a device for attaching ammunition boxes to a box support for an automatic weapon.

In order to re-supply (load) a gun mount with individual ammunition boxes, it is known that these boxes are placed on top, inserted, pulled or suspended on the gun mount.

German Patent 14 28 761 A1, for example, discloses that in order to fire the ammunition, several boxes containing cartridge feed belts are moved with the aid of traction means within a frame.

According to U.S. Pat. No. 4,951,548, the ammunition boxes are directly suspended from a feed track by attaching the rear and front ends of the box.

However, the disadvantage of these known devices is that they severely restrict access during the loading and reloading operation. Additional flaps and openings must be opened or removed during the loading and reloading operation. A particular disadvantage is that the heavily loaded ammunition boxes must be lifted up very high, so as to attach them to the frame or feed track of the gun mount.

In contrast, it is the object of the invention to make available a device of the aforementioned generic type, which ensures an easy fastening of the ammunition box on the gun mount of the automatic weapon, guarantees better access to the cartridge feed belt for the loading and reloading operation and reduces the ergonomic stress resulting from the fastening of the ammunition box on the gun mount.

SUMMARY OF THE INVENTION

The above object generally is achieved according to the present invention by a device for attaching ammunition boxes to a box support for an automatic weapon wherein: the box support is provided with shackles on both sides, with each of the shackles having a respective holder at a distance in a downward direction for suspending the ammunition box such that it can perform a pivoting movement, and with the ammunition box being provided with bearing bolts for this purpose; first and second fastening locations for the ammunition box are provided at spaced non-symmetrical distances from the holders in a longitudinal axial direction of the box support; first and second locking means for connection to the respective first and second fastening locations are disposed on the outside of the ammunition box in a longitudinal direction and at a distance that corresponds to the length (L) of the ammunition box; the distance (a) between the first fastening location and the holder corresponds to the distance between the holder and the first locking means when the ammunition box is suspended in the holder, so that in the position where the ammunition box with its bearing bolts is pivoted around the holder in the direction to cause the first locking means to engage the first fastening location, the ammunition box assumes a slanted loading position; and, the second fastening location is arranged on the box support at a distance from the first fastening location that corresponds to the length (L) of the ammunition box, so that the ammunition box assumes an ammunition unloading position following a pivoting movement around the first fastening location. Advantageous modifications of the invention follow from the features in the dependent claims.

The invention is based on the realization that the ammunition box of an automatic weapon can be attached in an ergonomic, energy-saving manner to the box support for the weapon. Starting with a simple suspended position of the ammunition box at a low height of the box support, the ammunition box is suspended from a box support holder at a distance below, such that it can pivot. In a subsequent, simple pivoting movement the box initially assumes an easily accessed, slanted loading position where one end of the ammunition box is automatically connected form-locking with a fastening location of the box support. As a result of this initial pivoting movement, a slanted loading position is created, which permits optimum access to the cartridge feed belt for the loading and reloading operation.

Owing to a subsequent rotational movement of the ammunition box around the last-mentioned fastening location, the ammunition box is pivoted upward to fit completely against the box support. In the process, the locking means arranged on the other end of the ammunition box also engage automatically in a corresponding fastening location on the box support.

In this locked-in position, the box support simultaneously functions as a lid for the ammunition box, so that no additional flaps and box lids are needed. The ergonomic stress is reduced considerably by the aforementioned steps for locking the box in place; wherein the ammunition box must be lifted only a short distance for suspending it in the box support holder. The movement for pivoting the ammunition box to the slanted loading and unloading position can be carried out without requiring an effort worth mentioning. Finally, pivoting the ammunition box against the box support at most requires a load application amounting to half the box weight.

The invention is described with the aid of an exemplary embodiment shown in more detail in the Figures and by mentioning additional advantages.

DETAILED DESCRIPTION OF THE PREFERRED EMBODIMENTS

Figure 1:
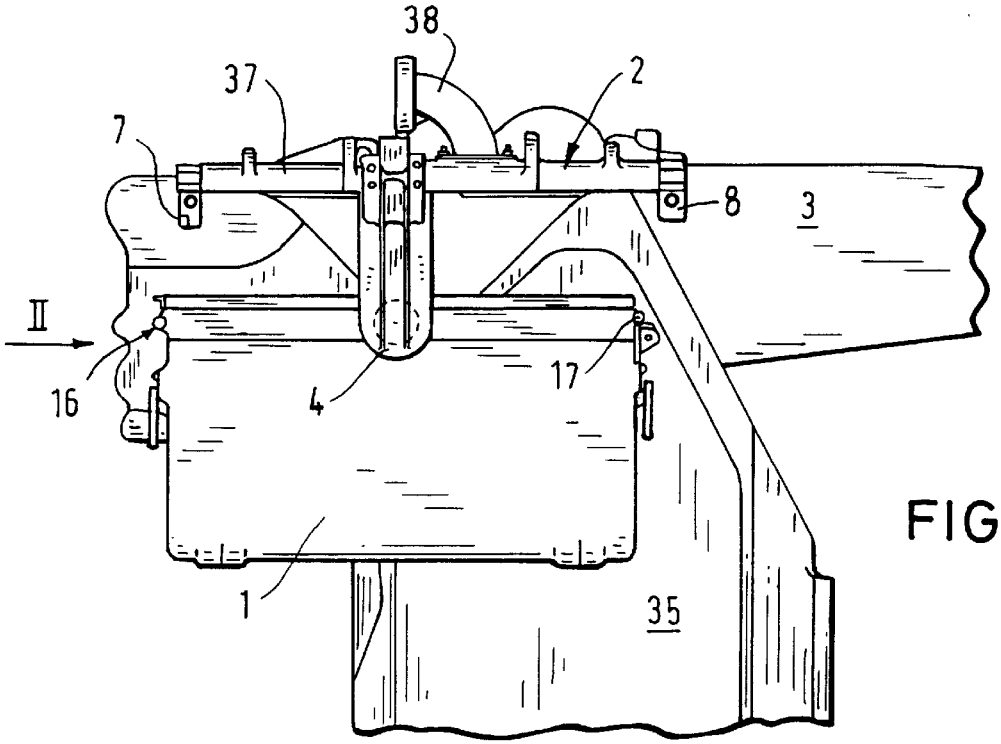
FIG. 1 is a view from the side of an automatic weapon with a box support according to the present invention and an ammunition box.
Figure 2:
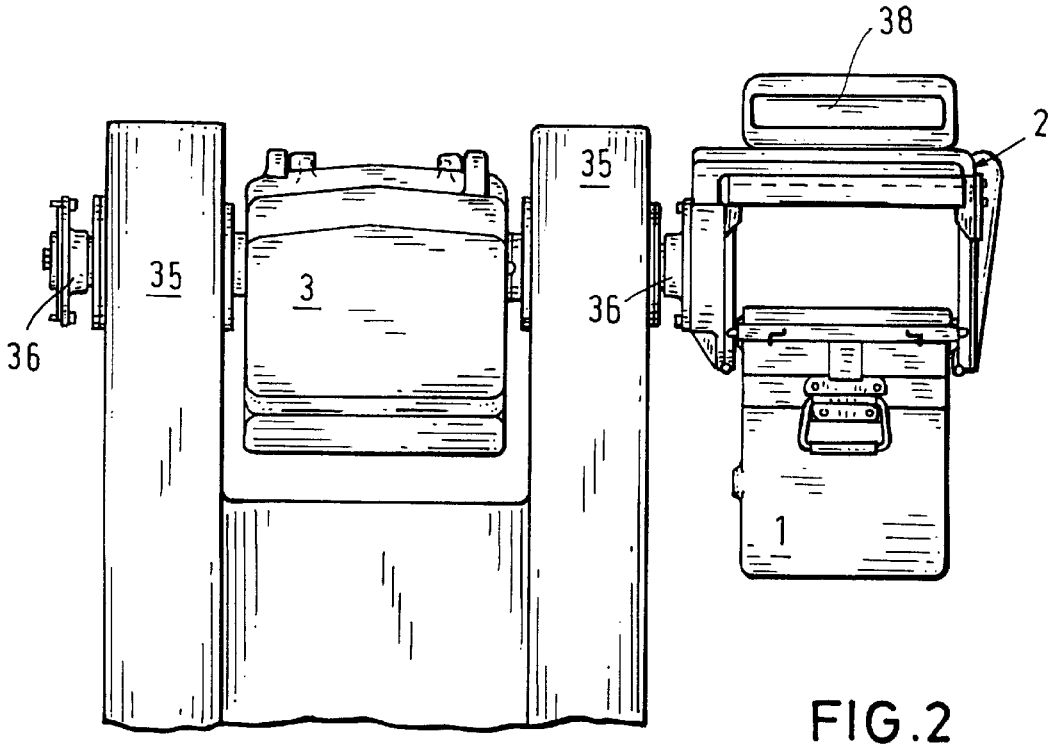
FIG. 2 is a view from the rear, in the direction of the reference numeral II in FIG. 1.
Figure 3:
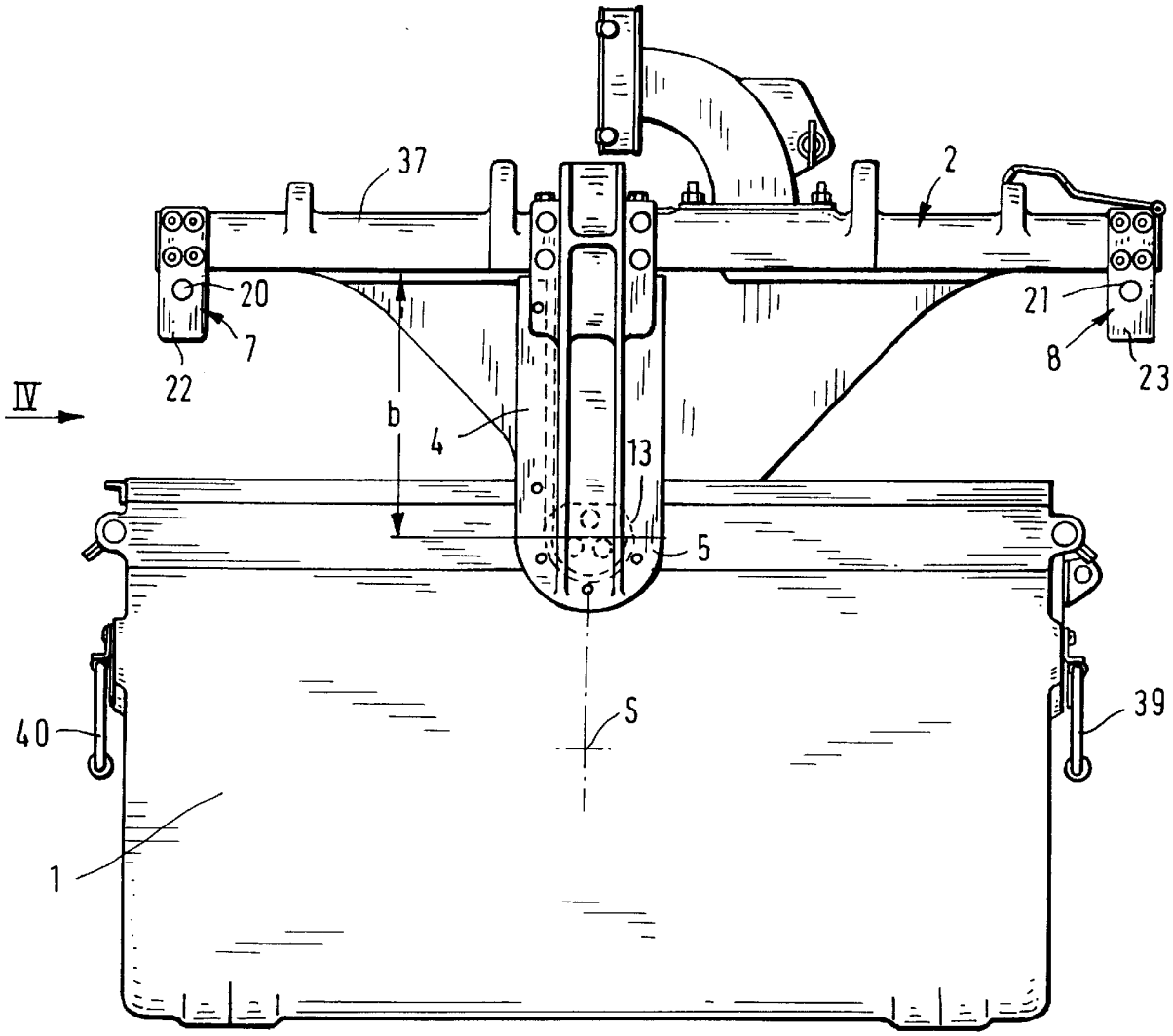
FIG. 3 is an enlarged view of the box support shown in FIG. 1, with the suspended ammunition box.
Figure 4:
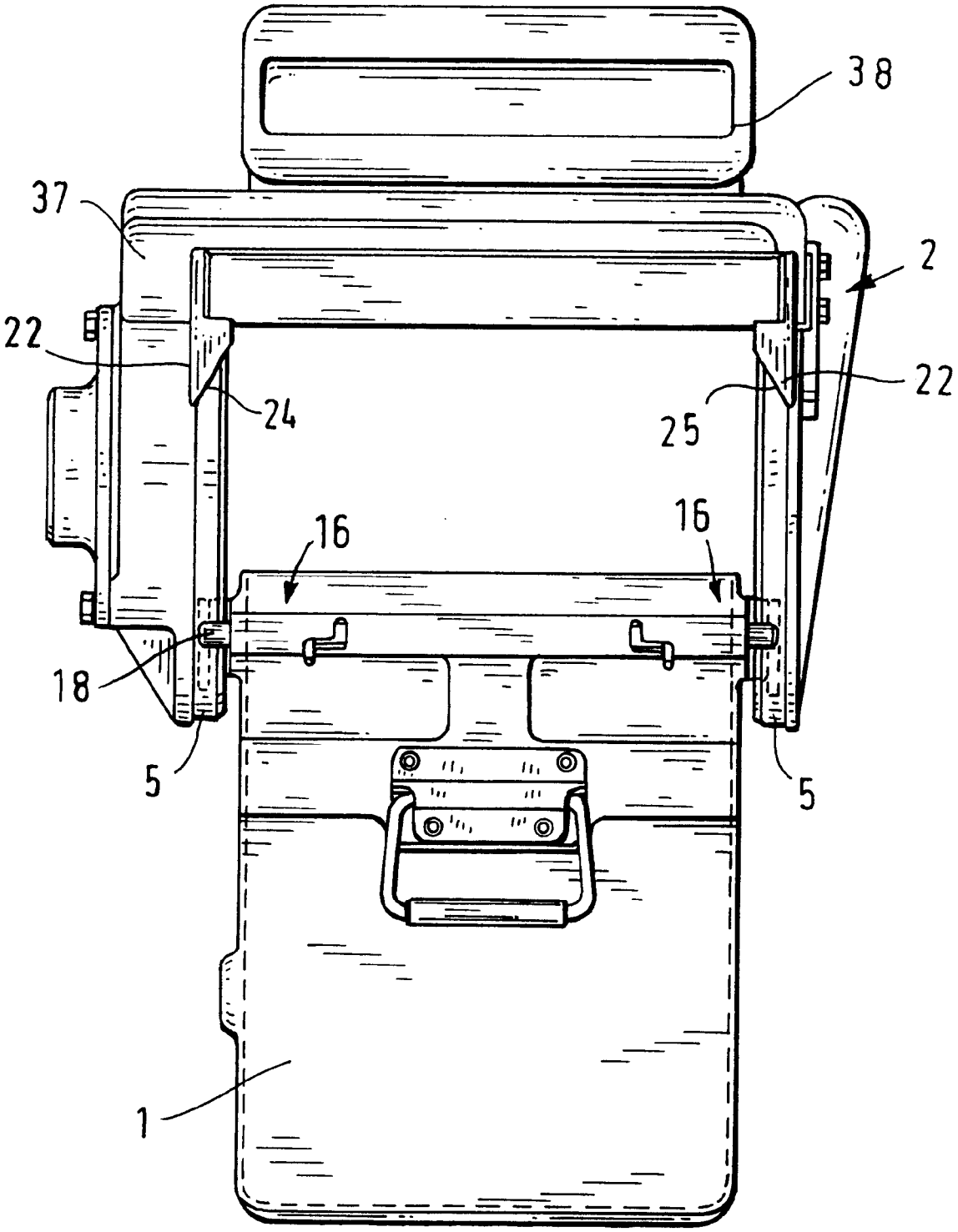
FIG. 4 is a view from the side, in the direction of the reference numeral IV in FIG. 3.

FIGS. 1 and 2 clearly show an automatic weapon 3, that is positioned height-adjustable and azimuth-adjustable (not shown with further detail) inside a gun mount 35. A respective fastening flange 36 for accommodating an ammunition box support 2 for an ammunition box 1 is located on the outside on each side of the gun mount. However, FIGS. 1 and 2 respectively show only one ammunition box support 2.

The box support 2, shown with enlarged detail in FIGS. 3 to 7, consists of a traversing part 37 having a width generally corresponding to that of an ammunition box 2, that is installed parallel to the weapon axis and is provided with shackles 4 on both sides. The shackles 4 are installed to extend substantially perpendicular to the plane of the traversing part or member 37 and, in the longitudinal direction of the traversing part 37 are disposed non-symmetrically relative to the respective ends of the traversing part 37. At a distance b in the downward direction, each shackle 4 has a holder 5 for suspending the ammunition box 1 such that it can perform a pivoting movement. The box support 2 is attached to the gun mount 35 by way of the respective shackle 4 that is facing the gun mount 35 and a respective fastening flange 36. The ammunition box 1 is provided with a pair of oppositely disposed bearing bolts 13 (FIG. 8) arranged on opposite longitudinally extending sides of the box 1. The bearing bolts 13 are located vertically above the center of gravity S at the upper end of side walls 14 of the ammunition box 1, provided the ammunition box 1 is horizontally oriented. If the weight is distributed symmetrically, all bearing bolts 13 are arranged in the center at the upper edge of side walls 14 of the ammunition box 1.

For suspending the bearing bolts 13, the holder 5 on box support 2 is adapted in the manner of a shell to the contour of bearing bolt 13 and is open toward the top on one side the right side in the side views. Thus the holder 5 has a generally "J" shape, with—reversed in the side views of the illustrated embodiment. Owing to the fact that each bearing bolt 13 is provided with a radial flange on each outer end, which flange 15 exceeds the diameter of the respective bolt shaft, the bearing bolt 13 is easily and securely positioned inside the shell-shaped contour of holder 5, thereby permitting an easy pivoting movement of ammunition box 1.

Fastening locations 7 and 8 for the ammunition box 1 are provided in a longitudinal axial direction 6 (FIG. 5) of box support 2 at non-symmetrical distances from the holders 5. These fastening locations 7, 8 consist of pairs of brackets 22, 23 respectively, which are attached on both sides to the ends of traversing part 37, for example, with screw connections. In the longitudinal direction, these brackets 22, 23 are provided with respective insertion bevels 24, 25 (FIGS. 4, 7) that respectively extend at a slant from the bottom toward the top. With the aid of these bevels 24, 25, locking means 16, 17 (FIG. 8) on the ammunition box 1 can be locked in place inside respective bores 20, 21 on the upper end of the respective insertion bevel 24, 25 on brackets 22, 23. The distance a between the first fastening location 7 and the holder 5 preferably corresponds to half the length L of the ammunition box 1. Thus, when occupying the fastening location 7, the ammunition box 1 assumes a slanted loading position 9 (FIG. 5) where its bearing bolts 13 are pivoted in direction 10 in the holder 5.

Relative to the first fastening location 7, the second fastening location 8 is arranged on the box support 2 at the distance of length L of the ammunition box 1. Thus, the ammunition box 1 assumes an ammunition feeding position 12 (FIG. 6) following a pivoting movement 11 around the first fastening location 7. In order to assume this position, the locking means or arrangements 16, 17 are arranged longitudinally on the outside of the ammunition box 1, spaced apart at the same distance of length L as the fastening locations 7 and 8.

Figure 5:
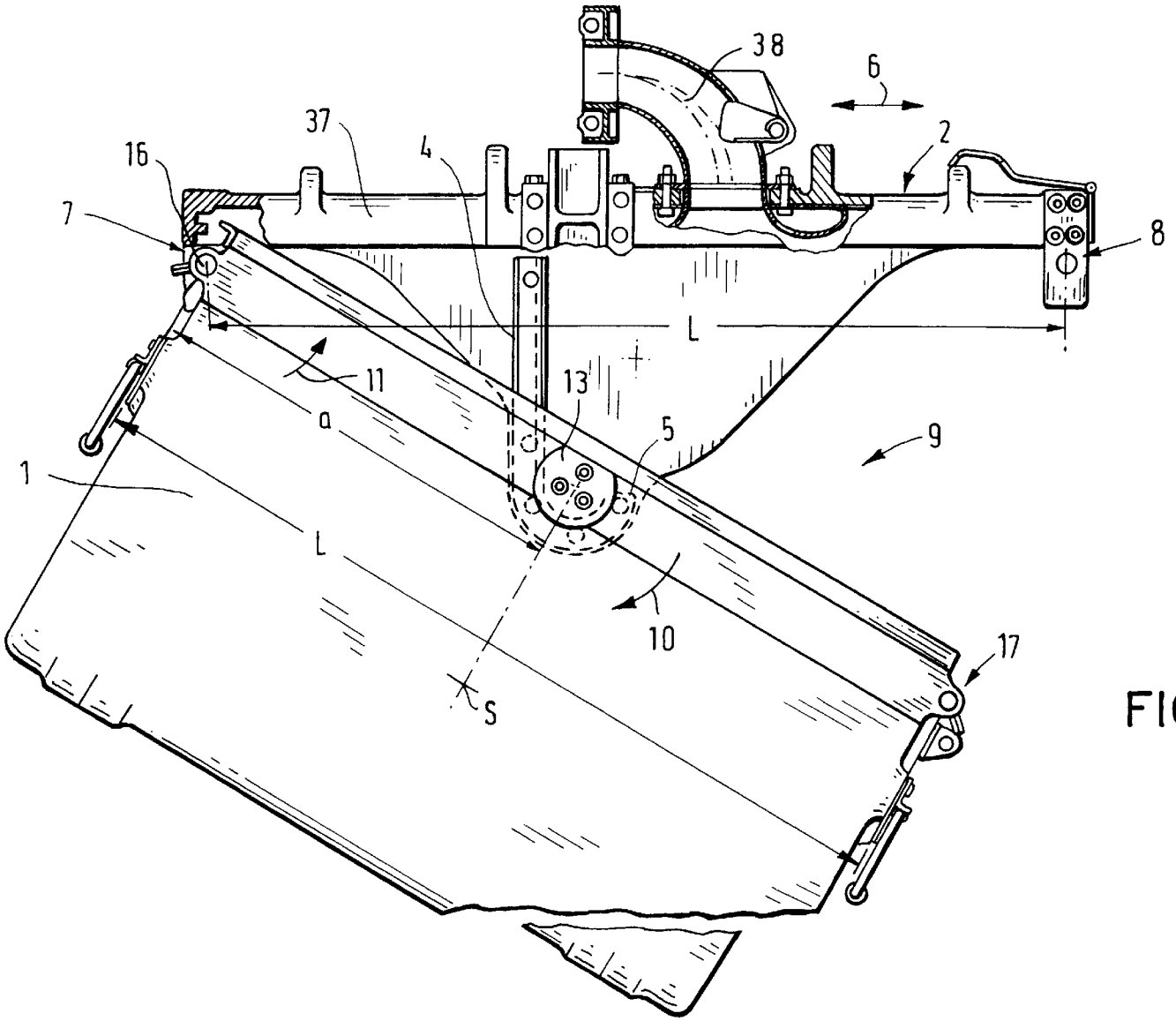
FIG. 5 shows the loading and unloading positions of the ammunition box.
Figure 6:
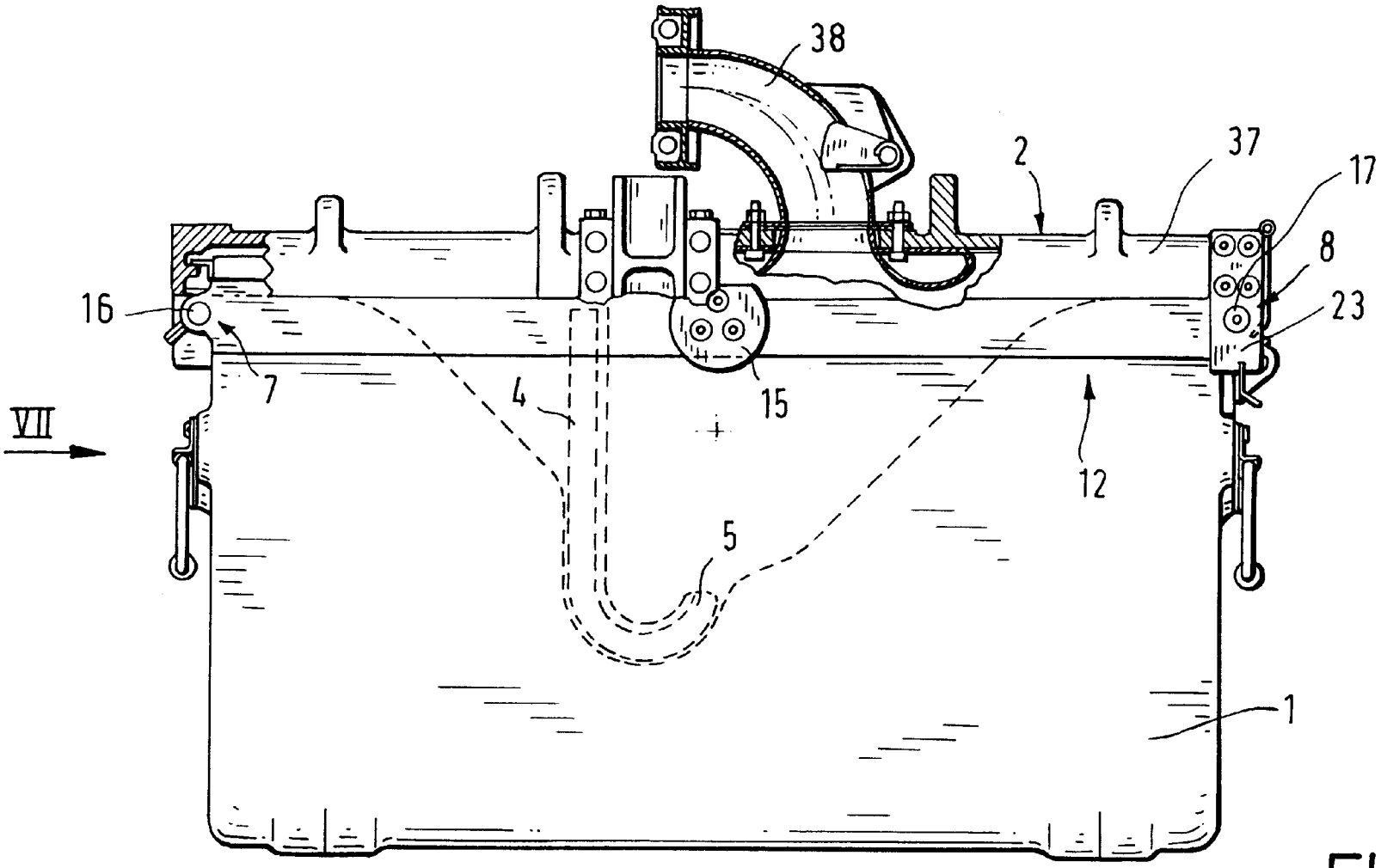
FIG. 6 shows the position where the ammunition box is pivoted to fit against the box support.
Figure 7:
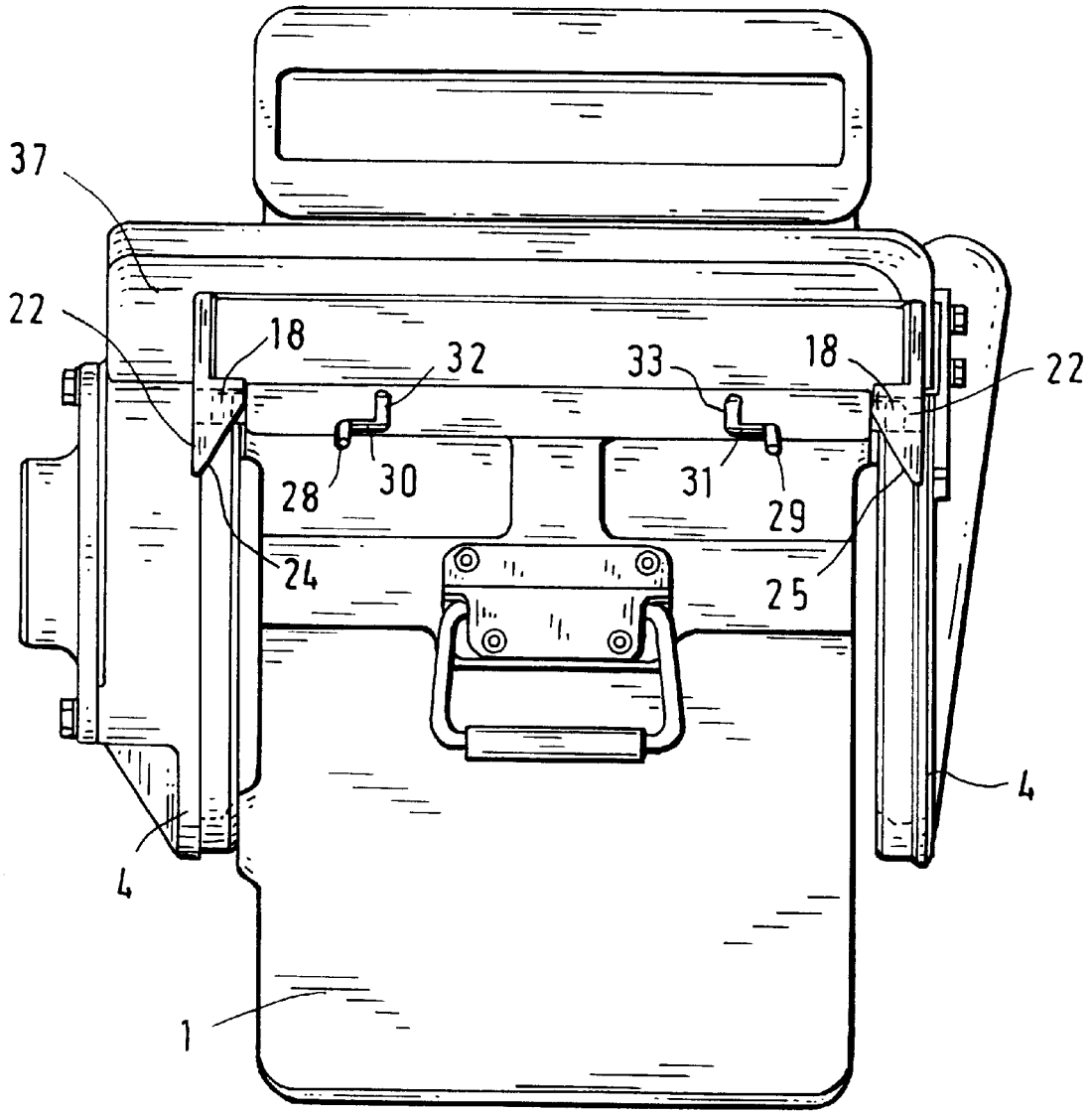
FIG. 7 is a view from the side in the direction of the reference numeral VII in FIG. 6.

The ammunition box 1 performs a circular movement around the fastening location 7 to assume the ammunition feeding position 12, so that the bearing bolts 13 moves out of the open ends of the shell-shaped holders 5. Thus, the holder 5 can be closed in the direction of fastening location 7 at a distance a, while it is open in the top half in the direction of opposite arranged fastening location 8 (FIG. 5).

Figure 8:
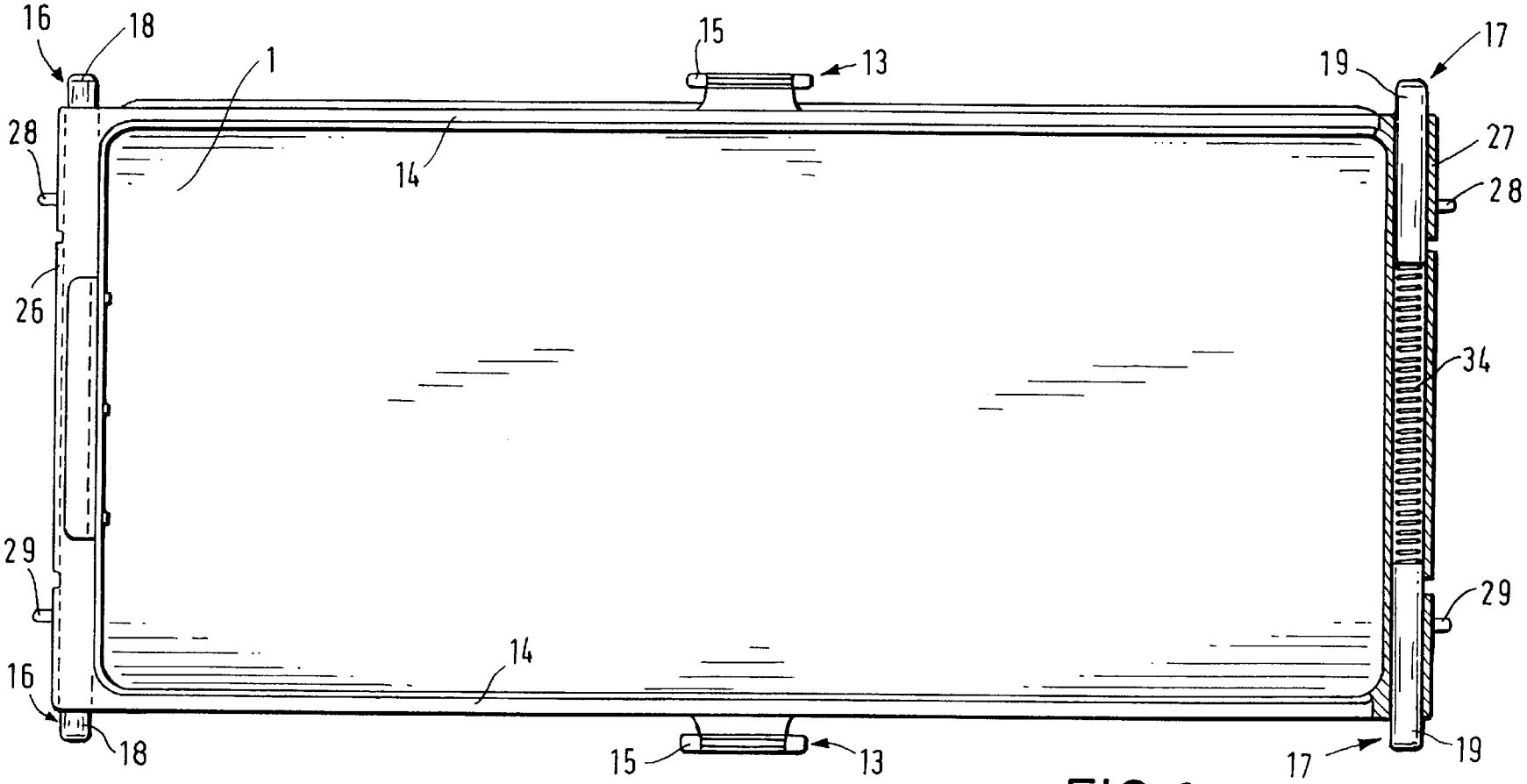
FIG. 8 shows the ammunition box in a view from above.

As shown in FIG. 8, the locking means 16, 17 are designed as respective spring-loaded bolts 18, 19, so that they can automatically engage in the bores 20, 21 of the brackets 22, 23. These bolts 18, 19 are guided inside respective tube-shaped guides 26, 27, wherein these guides are attached crosswise to the side surfaces 14 on the outside, at the upper end of the ammunition box 1. In order to release the bolts 18, 19 from the respective fastening locations 7, 8, each bolt 18, 19 of a fastening location is provided with a pair of radially outward extending guide pin 28, 29 that will release the bolts 18, 19 from bore 20, 21 when moved inside respective elongated slots 30, 31 counter to the force of a spring 34, and that can be secured in further respective circumferential slots 32, 33 for a non-frictional return movement.

The mode of operation for the arrangement according to the invention is as follows:

The weapon 3 is loaded in three stages. In the first stage, the ammunition box 1 is suspended in the holder 5 of box support 2.

In the second stage, the ammunition box 1 is pivoted around the rotational axis of holder 5, so that locking bolts 18 of the box end that is pivoted upwardly automatically engage in the bores 20 of fastening location 7. This slanted position of the box is dimensioned such that a cartridge feed belt, which is not shown here, can be reliably moved along by a cartridge discharge 38 for loading the weapon.

In the third stage, the ammunition box 1 is pivoted manually from the holder 5, completely around the fastening location 7 and against the box support 2. The box is again locked into place automatically at the fastening location 8 by the locking bolts 19 inside bores 21 of brackets 23. In this position, the ammunition box 1 is connected in a form-locking manner with the box support 2.

The removal of the ammunition box from the box support 2 occurs by reversing these steps, wherein the guide pins 28, 29 one after another assume the engaged positions in the respective circumferential slots 32, 33 in the above-described manner. The box 1 in this case can initially be pivoted back with the aid of handle 39 from the third via the second to the first stage and can be replaced easily with the aid of another handle 40.

The invention now being fully described, it will be apparent to one of ordinary skill in the art that many changes and modifications can be made thereto without departing from the spirit or scope of the invention as set forth herein.

What is claimed is:

1. A device for attaching ammunition boxes to a box support for an automatic weapon comprising:

a box support mounted on an outer wall of a gun mount for an automatic weapon and extending parallel to a longitudinal axis of the weapon, said box support being provided with downwardly extending shackles on both sides, with each of said shackles having a respective holder at a distance in a downward direction from the box support for engaging one of a pair of opposed bearing bolts extending from longitudinal side surfaces of an ammunition box to suspend the ammunition box such that it can perform a pivoting movement;

first and second fastening locations for the ammunition box provided on the box support at spaced non-symmetrical distances from the holders in a longitudinal axial direction of the box support;

first and second locking means for connection to the respective first and second fastening locations disposed on the outside of the ammunition box in longitudinal direction and at a distance that corresponds to the length (L) of the ammunition box;

and wherein a distance (a) between the first fastening location and the holders corresponds to the distance between the holders and the first locking means when the ammunition box is suspended in the holders, so that in the position where the ammunition box with its bearing bolts is pivoted around the holders in a direction to cause the first locking means to engage the first fastening location, the ammunition box assumes a slanted loading position, and, the second fastening location is arranged on the box support at a distance from the first fastening location corresponding to the length (L) of the ammunition box, so that the ammunition box assumes an ammunition unloading position following a pivoting movement around the first fastening location.

2. The device according to claim 1, wherein the distance (a) between the first fastening location and the holder corresponds to half the length (L) of the ammunition box.

3. The device according to claim 1, wherein the bearing bolts are arranged on both opposite side walls extending in longitudinal axial direction of the ammunition box, and in the center of the upper end of both said side walls.

4. The device according to claims 3, wherein each bearing bolt is provided with a respective outward radially extending flange on its outer end, which flange has a diameter that exceeds a shaft diameter of the bolt.

5. The device according to claims 4, wherein each holder for suspending the bearing bolts is adapted in the manner of a shell to the contour of the bearing bolts, and is open toward the top on one side.

6. The device according to claim 1, wherein the locking means are spring-loaded bolts, which can engages bores of brackets of the respective fastening location for the box support.

7. The device according to claim 6, wherein the brackets are provided with insertion bevels for automatic engagement of the bolts and directing them to the respective bores.

8. The device according to claim 7, wherein the bolts are guided inside tube-shaped guides via guide pins that project radially outward from the bolts and are moved inside elongated axially extending slots in the guides, and that can secure the bolts by engagement in circumferentially extending slots in the guides.

* * * * *